US005502875A

United States Patent [19]

Stolz et al.

[11] Patent Number: 5,502,875

[45] Date of Patent: Apr. 2, 1996

[54] CONTINUOUS DRIVE UNIT FOR COMBERS, A DRAFTING ARRANGEMENT AND A COILER CAN

[75] Inventors: Thomas Stolz, Rickenbach; Viktor Pietrini, Sirnach; Oliver Wuest, Seuzach, all of Switzerland

[73] Assignee: Rieter Machine Works, Ltd., Winterthur, Switzerland

[21] Appl. No.: 294,493

[22] Filed: Aug. 23, 1994

[30] Foreign Application Priority Data

Aug. 25, 1993 [CH] Switzerland ..... 02522/93

[51] Int. Cl.[6] ..... D01G 19/00; D01H 5/00

[52] U.S. Cl. ..... 19/115 R; 19/236; 19/239; 474/86

[58] Field of Search ..... 474/84, 85, 86, 474/87, 88; 19/115 A, 115 R, 236, 293

[56] References Cited

U.S. PATENT DOCUMENTS

| | | | |
|---|---|---|---|
| 3,035,400 | 5/1962 | Stahlecker | 474/86 X |
| 4,987,734 | 1/1991 | Meyer | 19/236 X |
| 5,230,125 | 7/1993 | Clement et al. | 19/115 R |
| 5,313,689 | 5/1994 | Oexler | 19/239 |

FOREIGN PATENT DOCUMENTS

| | | |
|---|---|---|
| 0314310 | 9/1988 | European Pat. Off. . |
| 0404263 | 6/1990 | European Pat. Off. . |
| 4119877 | 1/1992 | Germany . |
| 372231 | 9/1963 | Switzerland . |
| 1331740 | 4/1969 | United Kingdom . |
| 2086440 | 10/1981 | United Kingdom . |

*Primary Examiner*—John J. Calvert

*Attorney, Agent, or Firm*—McAulay Fisher Nissen Goldberg & Kiel

[57] ABSTRACT

The combing machine has a row of combing heads which are allocated with a drive shaft extending parallel to the longitudinal direction of the row. The combing heads are provided downstream with a drafting arrangement whose cylinders are arranged horizontally and at a right angle to the drive shaft. A funnel wheel and a can plate are rotatable about vertical axes. The transmission for driving the cylinders of the drafting arrangement, the funnel wheel and the can plate has two V-drives with a crossed toothed belt each. The first V-drive connects the drive shaft to a drafting arrangement drive shaft which is parallel to the cylinders of the drafting arrangement. The second V-drive connects a shaft which is parallel to the drafting arrangement drive shaft to a vertical drive shaft for the funnel wheel and the can plate.

13 Claims, 1 Drawing Sheet

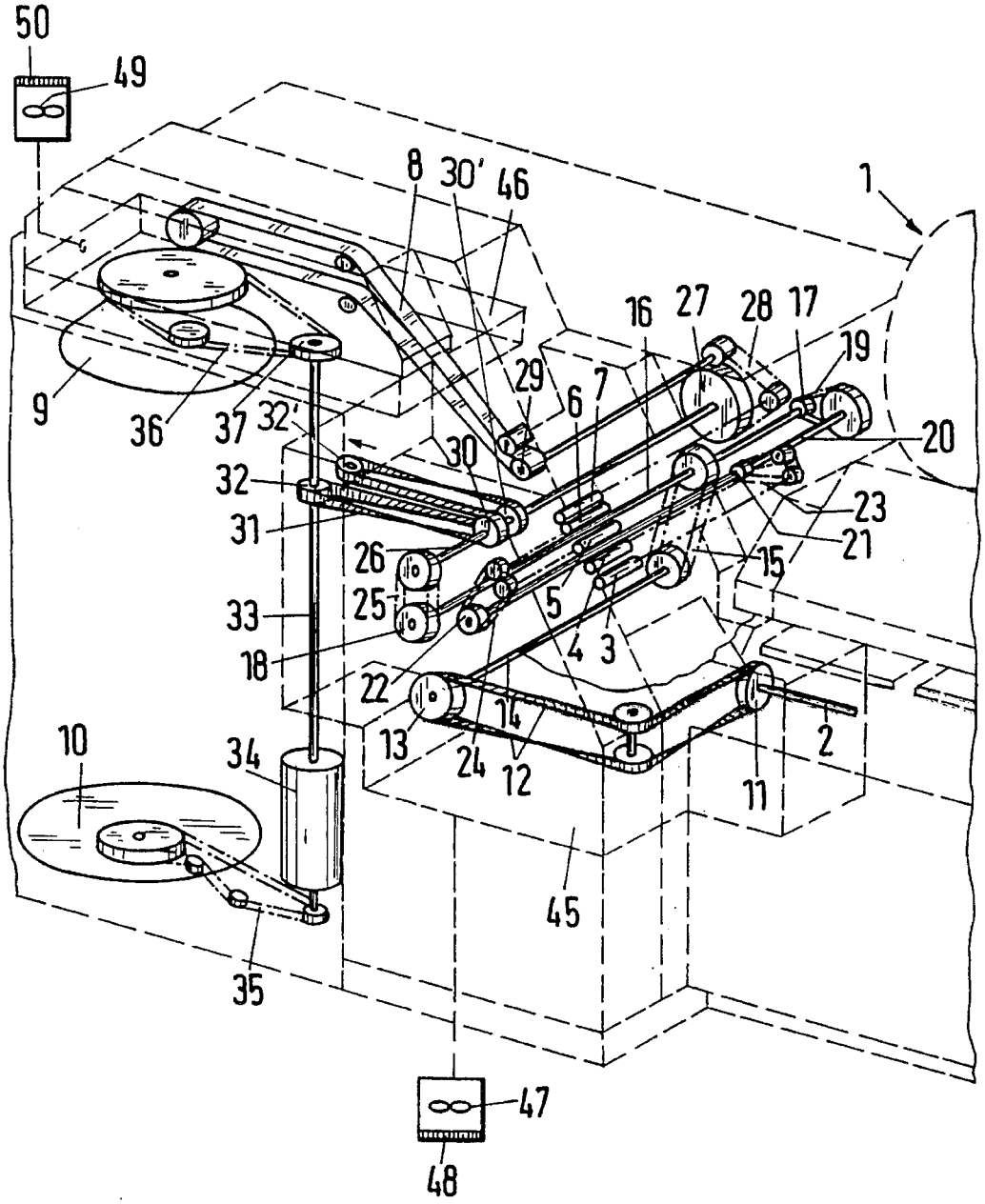
50
49
8
30'
46
1
16
27
28
17
19
29
6
7
20
9
36
37
32'
30
32
23
31
21
26
15
25
5
33
4
3
18
22
14
13
24
12
2
10
34
11
45
35
47
48

CONTINUOUS DRIVE UNIT FOR COMBERS, A DRAFTING ARRANGEMENT AND A COILER CAN

This invention relates to a combing machine. More particularly, this invention relates to a transmission for a combing machine.

As is known, combing machines have been constructed such as described in German OS 4119877 with a row of combing heads disposed along a longitudinal axis and with a drafting arrangement for receiving and drafting the slivers from the combing heads. Typically, the drafting arrangement includes rollers which are arranged approximately horizontally and at a right angle to the longitudinal axis or direction of the row of combing heads. Still further, a can plate has been provided for mounting a sliver can to receive drafted sliver from the drafting arrangement as well as a funnel wheel for directing the drafted slivers from the drafting arrangement into the sliver can. In addition, each of the can plate and the funnel wheel have been mounted for rotation about a vertical axis.

The drive for such a combing machine has employed a main drive shaft which extends parallel to the longitudinal direction of the row of combing heads. In addition, in order to drive the various components off the main drive shaft, drive devices with several directional changes of 90° each have been used, for example with angular wheels and, in part, worms and worm wheels. However, these drive devices have been relatively complex and expensive.

Accordingly, it is an object of the invention to provide a relatively simple transmission for driving the components of a combing machine.

It is another object of the invention to simplify the drive of a drafting arrangement and can plate in a combing machine.

It is another object of the invention to simplify and reduce the cost of a transmission for the drafting arrangement cylinders, can plate and funnel wheel of a combing machine.

Briefly, the invention is directed to a combing machine comprising a row of combing heads disposed along a longitudinal axis, a drafting arrangement for receiving and drafting slivers from the combing heads with the drafting arrangement including a plurality of horizontal cylinders disposed transversely of the longitudinal axis and a can plate rotatably mounted in a vertical axis for mounting a sliver can thereon to receive drafted sliver from the drafting arrangement. In addition, the combing machine includes a funnel wheel rotatably mounted on a vertical axis for directing drafted slivers from the drafting arrangement into a sliver can on the can plate.

In addition, the transmission for the combing machine includes a main drive shaft which extends parallel to the longitudinal axis, a drafting arrangement drive shaft parallel to and drivingly connected to the cylinders of the drafting arrangement and a vertical drive shaft which is parallel to the vertical axes of the can plate and funnel wheel and which is drivingly connected to the cam plate and funnel wheel.

In accordance with the invention, a first V-drive drivingly connects the main drive shaft to the drafting arrangement drive shaft. This V-drive includes a crossed toothed belt for transmitting a drive force from the main drive shaft to the drafting arrangement drive shaft.

In addition, a transfer shaft is disposed parallel to and is drivingly connected to the drafting arrangement drive shaft while a second V-drive drivingly connects this transfer shaft to the vertical drive shaft. In addition, this second V-drive includes a crossed toothed belt for transmitting a drive force from the transfer shaft to the vertical shaft.

Preferably, the cylinders of the drafting arrangement are driven by the drafting arrangement drive shaft via further toothed belts.

The power transmission by means of toothed belts has the additional advantage of being subject to less play than power transmissions via toothed wheels, angular wheels and the like.

These and other objects and advantages of the invention will become more apparent from the following detailed description taken in conjunction with the accompanying drawing wherein:

The drawing schematically illustrates a perspective exploded view of a combing machine employing a transmission in accordance with the invention.

Referring to the drawing, the combing machine comprises a row of combing heads disposed along a longitudinal axis, of which only the outlines of the last combing head 1 of the row are indicated. The working parts of the combing heads are driven by a motor (not shown) via gear devices (not shown) which also drive a drive shaft 2 extending parallel to the longitudinal direction of the row of combing heads.

The slivers which are made from combed fiber material and are issued by the combing heads 1 are jointly supplied to the drafting arrangement, of which only five bottom rollers 3, 4, 5, 6 and 7 are shown. Three pressure rollers (not shown) cooperate with these rollers 3–7. The rollers of the drafting arrangement 3, 4, 5, 6, 7 are arranged to extend horizontally and at a right angle to the longitudinal direction of the row of combing heads 1 to receive and draft the slivers into a fleece.

The fleece supplied by the drafting arrangement 3, 4, 5, 6, 7 is conveyed in the form of a sliver on a conveying belt 8 to a funnel wheel 9 which is rotatable about a vertical axis. The funnel wheel 9 directs or deposits the sliver in a can (not shown) which stands on a can plate 10 during operation, which plate is also rotatable about a vertical axis.

A toothed wheel 11 is disposed on the drive shaft 2 allocated to the combing heads 1, which wheel 11 is coupled via a first V-drive with a first crossed toothed belt 12, which is placed around two deflection pulleys, to a toothed wheel 13 which is disposed on a drafting arrangement drive shaft 14 which is parallel to and which is drivingly connected to the drafting cylinders 3, 4, 5, 6, 7.

The drive shaft 14 drives, via a further toothed belt 15, a second shaft 16 which is parallel to the drafting cylinders 3, 4, 5, 6, 7 and carries two additional toothed wheels 17 and 18.

Toothed wheel 17 drives, via a toothed belt 19 used a toothed wheel, shaft 20 on which two toothed wheels 21 and 22 are disposed. Toothed wheel 21 drives, via a toothed belt 23, two toothed wheels which are disposed on the two first drafting cylinders 3 and 4, and toothed wheel 22 drives via a toothed belt 24 two toothed wheels which are disposed on the third and fourth drafting cylinders 5 and 6, respectively.

Toothed wheel 18 on the shaft 16 drives, via a toothed belt 25, a transfer shaft 26 which is parallel to the drafting arrangement drive shaft 14.

A toothed wheel 27 is disposed on the transfer shaft 26 and drives two further toothed wheels via a toothed belt 28, of which one is disposed on the shaft of the fifth drafting cylinder 7 and the other is disposed on the shaft of a drive roller 29 for the conveyor belt 8.

Furthermore, a toothed wheel 30 is disposed on the transfer shaft 26, which wheel 30 drives a toothed wheel 32 via a second V-drive with a crossed toothed belt 31. The wheel 32 is attached to a vertical drive shaft 33. The toothed belt 31 also extends around two freely rotatable deflection pulleys or toothed wheels 30' and 32', of which the wheel 30' is held on the transfer shaft 26 and the other is arranged parallel to and above the toothed wheel 32. The pulley or wheel 32' functions as a tension wheel for tensioning the belt 31. The pulley 32' is displaceably mounted in a horizontal direction (schematically shown by an arrow) on the machine frame. The belt 31 extends from the wheel 30 to the wheel 32 over the wheel 32' to the wheel 30' and at least to the wheel 32.

The vertical shaft 33 is used as a drive shaft for the can plate 10 and for the funnel wheel 9. The shaft 33 is coupled with the can plate 10 via a commercially available transmission including a step-down gear 34 and a chain 35. The shaft 33 is coupled with the funnel wheel 9 via a V-belt 36. The V-belt 36 extends around a pulley 37 disposed on the shaft 33, which pulley 37 is arranged as a variable drive disk. By readjusting the variable drive disk, it is possible to change the speed of the funnel wheel 9 by +/−5%, for example.

The two crossed toothed belts 12 and 31 as well as the forward toothed belts 24 and 25 and, preferably, the V-belt 36 are arranged in the casing of the combing machine in a schematically shown enclosed chamber 45 and 46.

A means is also provided for maintaining a pressure above atmospheric in each of the chambers 45, 46 so that penetration of fiber fly into the chambers 45, 46 is prevented. As indicated, the means for maintaining a pressure above atmospheric in the chamber 45 includes a ventilator 47 having a filter screen 48 through which ambient air can be drawn into the chamber 45. A similar ventilator 49 having a screen 50 is employed to draw ambient air into the other chamber 46.

The chambers 45, 46 may be connected to an extension for a further chamber (not shown) which receives the rear toothed belts 15, 19, 23, 28.

The invention thus provides a combing machine with a relatively simple and inexpensive transmission for driving the drafting arrangement of the combing machine as well as the funnel wheel and can plate.

Further, the invention provides a transmission which is subject to relatively small play because of the use of the crossed toothed belts.

What is claimed is:

1. A combing machine comprising a row of combing heads disposed along a longitudinal axis to deliver slivers therefrom;

a drafting arrangement for receiving and drafting slivers from said combing heads, said drafting arrangement including a plurality of horizontal cylinders disposed transversely of said longitudinal axis;

a can plate for mounting a sliver can thereon to receive drafted sliver from said drafting arrangement, said can plate being rotatable about a vertical axis;

a funnel wheel for directing drafted slivers from said drafting arrangement into a sliver can on said can plate, said funnel wheel being rotatable about said vertical axis;

a main drive shaft extending parallel to said longitudinal axis;

a drafting arrangement drive shaft parallel to and drivingly connected to said cylinders of said drafting arrangement;

a vertical drive shaft parallel to said vertical axis and drivingly connected to said can plate and said funnel wheel;

a first V-drive drivingly connecting said main drive shaft to said drafting arrangement drive shaft, said V-drive including a crossed toothed belt for transmitting a drive force from said main drive shaft to said drafting arrangement drive shaft;

a transfer shaft parallel to and drivingly connected to said drafting arrangement drive shaft; and a second V-drive drivingly connecting said transfer shaft to said vertical drive shaft, said second V-drive including a crossed toothed belt for transmitting a drive force from said transfer shaft to said vertical shaft.

2. A combing machine as set forth in claim 1 which further comprises a chamber enclosing at least one of said crossed belts and means for maintaining a pressure above atmospheric in said chamber.

3. A combing machine as set forth in claim 1 which further comprises at least one toothed belt drivingly connecting said drafting arrangement drive shaft to at least one of said drafting cylinders.

4. A combing machine as set forth in claim 3 which further comprises a chamber enclosing said toothed belts and means for maintaining a pressure above atmospheric in said chamber.

5. A combing machine as set forth in claim 1 which further comprises a V-belt drivingly connecting said vertical drive shaft to said funnel wheel.

6. A combing machine as set forth in claim 5 which further comprises a variable drive disk on said vertical shaft for driving said V-belt.

7. A combing machine as set forth in claim 1 which further comprises a transmission including a step-down gear and a chain drivingly connecting said vertical drive shaft to said can plate.

8. In a combing machine, the combination comprising a row of combing heads;

a drafting arrangement including a plurality of cylinders for drafting sliver delivered from said combing heads therebetween;

a can plate for mounting a sliver can thereon to receive drafted sliver from said drafting arrangement, said can plate being rotatable about a vertical axis;

a funnel wheel for directing drafted slivers from said drafting arrangement into a sliver can on said can plate, said funnel wheel being rotatable about said vertical axis;

a main drive shaft drivingly connected to the combining machine;

a drafting arrangement drive shaft parallel to and drivingly connected to said cylinders of said drafting arrangement;

a vertical drive shaft parallel to said vertical axis and drivingly connected to said can plate and said funnel wheel;

a first V-drive drivingly connecting said main drive shaft to said drafting arrangement drive shaft, said V-drive including a crossed toothed belt for transmitting a drive force from said main drive shaft to said drafting arrangement drive shaft;

a transfer shaft parallel to and drivingly connected to said drafting arrangement drive shaft; and a second V-drive drivingly connecting said transfer shaft to said vertical drive shaft, said second V-drive including a crossed toothed belt for transmitting a drive force from said transfer shaft to said vertical shaft.

9. The combination as set forth in claim 8 which further comprises at least one toothed belt drivingly connecting said drafting arrangement drive shaft to at least one of said drafting cylinders.

10. The combination as set forth in claim 8 which further comprises a V-belt drivingly connecting said vertical drive shaft to said funnel wheel.

11. The combination as set forth in claim 10 further comprises a variable drive disk on said vertical shaft for driving said V-belt.

12. The combination as set forth in claim 8 which further comprises a transmission including a step-down gear and a chain drivingly connecting said vertical drive shaft to said can plate.

13. In a combing machine, the combination comprising a drafting arrangement including a plurality of cylinders for drafting sliver therebetween;

a can plate for mounting a sliver can thereon to receive drafted sliver from said drafting arrangement, said can plate being rotatable about a vertical axis;

a funnel wheel for directing drafted slivers from said drafting arrangement into a sliver can on said can plate, said funnel wheel being rotatable about said vertical axis;

a main drive shaft;

a drafting arrangement drive shaft parallel to and drivingly connected to said cylinders of said drafting arrangement;

a vertical drive shaft parallel to said vertical axis and drivingly connected to said can plate and said funnel wheel;

a transmission including a step-down gear and a chain drivingly connecting said vertical drive shaft to said can plate;

a first V-drive drivingly connecting said main drive shaft to said drafting arrangement drive shaft, said V-drive including a crossed toothed belt for transmitting a drive force from said main drive shaft to said drafting arrangement drive shaft;

a transfer shaft parallel to and drivingly connected to said drafting arrangement drive shaft; and a second V-drive drivingly connecting said transfer shaft to said vertical drive shaft, said second V-drive including a crossed toothed belt for transmitting a drive force from said transfer shaft to said vertical shaft.

* * * * *

UNITED STATES PATENT AND TRADEMARK OFFICE
CERTIFICATE OF CORRECTION

PATENT NO. : 5,502,875
ISSUED : April 2, 1996
INVENTOR(S) : THOMAS STOLZ, ET AL

It is certified that this error appears in the above-identified patent and that said Letters Patent is hereby corrected as shown below:

COLUMN 2, lines 47 to 48 "used a toothed wheel" should be -a-

Signed and Sealed this
Second Day of July, 1996

Bruce Lehman

*Attest:*

BRUCE LEHMAN

*Attesting Officer*

*Commissioner of Patents and Trademarks*